US010890127B2

(12) United States Patent
Ahn

(10) Patent No.: US 10,890,127 B2
(45) Date of Patent: Jan. 12, 2021

(54) PURGE CONCENTRATION CALCULATION CONTROL METHOD IN ACTIVE PURGE SYSTEM AND FUEL AMOUNT CONTROL METHOD USING THE SAME

(71) Applicants: HYUNDAI MOTOR COMPANY, Seoul (KR); KIA MOTORS CORPORATION, Seoul (KR)

(72) Inventor: Tae-Ho Ahn, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/673,235

(22) Filed: Nov. 4, 2019

(65) Prior Publication Data

US 2020/0191072 A1 Jun. 18, 2020

(30) Foreign Application Priority Data

Dec. 17, 2018 (KR) ..... 10-2018-0163001

(51) Int. Cl.

| | |
|---|---|
| ***F02D 41/00*** | (2006.01) |
| ***F02M 25/08*** | (2006.01) |
| ***F02M 35/10*** | (2006.01) |
| ***F02D 41/30*** | (2006.01) |

(52) U.S. Cl.

CPC ..... *F02D 41/0032* (2013.01); *F02D 41/0042* (2013.01); *F02D 41/0045* (2013.01); *F02D 41/3005* (2013.01); *F02M 25/0836* (2013.01); *F02M 25/0872* (2013.01); *F02M 35/10222* (2013.01); *F02D 2200/0414* (2013.01)

(58) Field of Classification Search

CPC ..... F02D 41/0032; F02D 41/0042; F02D 41/0045; F02M 25/08; F02M 25/0872

USPC ..... 701/103; 123/516, 518–520

See application file for complete search history.

(56) References Cited

U.S. PATENT DOCUMENTS

| | | | | |
|---|---|---|---|---|
| 10,655,570 | B1 * | 5/2020 | Sager | F02M 25/0836 |
| 2017/0342918 | A1 * | 11/2017 | Sager | F02M 25/0854 |
| 2018/0372030 | A1 * | 12/2018 | Achleitner | F02M 25/089 |
| 2019/0113007 | A1 * | 4/2019 | Kato | F02M 25/0809 |
| 2019/0211760 | A1 * | 7/2019 | Choi | F02M 35/10222 |
| 2020/0003163 | A1 * | 1/2020 | Niemeyer | F02D 41/0032 |
| 2020/0063671 | A1 * | 2/2020 | Asanuma | F02D 41/004 |
| 2020/0149485 | A1 * | 5/2020 | Asanuma | F02D 41/0045 |

FOREIGN PATENT DOCUMENTS

KR 10-0290337 B1 3/2001

* cited by examiner

*Primary Examiner* — Erick R Solis
(74) *Attorney, Agent, or Firm* — Brinks Gilson & Lione

(57) ABSTRACT

A purge concentration calculation control method in an active purge system for purging a fuel evaporation gas by using a purge pump may include: calculating the purge concentration by using the RPM of the purge pump, and the pressure at a rear end of the purge pump; and controlling a purge valve in order to satisfy a target purge flow rate and the purge fuel amount by using the calculated purge concentration.

11 Claims, 13 Drawing Sheets

PURGE CONCENTRATION CALCULATION CONTROL METHOD IN ACTIVE PURGE SYSTEM AND FUEL AMOUNT CONTROL METHOD USING THE SAME

CROSS-REFERENCE TO RELATED APPLICATION

This application claims priority to and the benefit of Korean Patent Application No. 10-2018-0163001, filed on Dec. 17, 2018, the entire contents of which are incorporated herein by reference.

FIELD

The present disclosure relates to a purge concentration calculation control method and a fuel amount control method using the same.

BACKGROUND

The statements in this section merely provide background information related to the present disclosure and may not constitute prior art.

The fuel stored in a fuel tank of a vehicle is evaporated according to the flow and the internal temperature in the fuel tank to generate a fuel evaporation gas. When such a fuel evaporation gas is leaked into the atmosphere, it causes an environmental pollution problem. In order to prevent this, as in the technology disclosed in Korean Patent 10-0290337 (Oct. 24, 2001), a purge system for collecting the evaporation gas into the canister and flowing it into an intake system of an engine to re-combust it is currently being applied.

The conventional purge system as in Korean Patent 10-0290337 (Oct. 24, 2001) supplies the evaporation gas to the intake system by using the pressure acting on the evaporation gas according to the negative pressure formed in the intake system. However, in the case of the engine equipped with a turbocharger, we have discovered that it is difficult to generate a negative pressure at the front end of an intake valve of the engine, such that it difficult to apply the purge system using the conventional intake negative pressure.

SUMMARY

The amount of purge gas supplied by the active purge system directly affects the operating performance of an engine. For example, when the purge gas rich in fuel components flows into the idle state or, conversely, lean air flows therein, a too lean or rich combustion atmosphere may cause to turn off the engine.

Therefore, when the evaporation gas is purged by the active purge system (APS), it is desired to accurately calculate the concentration of the fuel components (hydrocarbons and HC) in the purge gas to appropriately correct the fuel amount based on the above.

In addition, in the active purge system, as illustrated in FIG. 7, since a time is needed until the purge gas discharged by a purge pump reaches at the intake manifold through a long passage, it is desired to accurately estimate the flow rate of the purge gas and the concentration (purge concentration) of the fuel components in the purge gas when the purge gas has reached the intake manifold.

The present disclosure provides a method capable of controlling the active purge system by accurately calculating the purge concentration, and also appropriately controlling the fuel amount through the calculated purge concentration in the vehicle adopting the active purge system.

In one form of the present disclosure, the method includes: as a purge concentration calculation control method in an active purge system for purging a fuel evaporation gas (purge gas) by using a purge pump, calculating, by a controller, a purge concentration of the purge gas by using the revolutions per minute (RPM) of the purge pump, and a pressure at the rear end of the purge pump; determining, by the controller, a target purge flow rate of the purge gas based on the calculated purge concentration and a flow rate of the purge gas; and controlling, by the controller, a purge valve based on the target purge flow rate and a purge fuel amount.

In order to measure the purge concentration more accurately, as one form of the present disclosure, the purge concentration is calculated when a certain time has elapsed since an operation of the purge pump started or when a difference between a target RPM of the purge pump and a current RPM of the purge pump is within a predetermined range.

In one form, the present disclosure further includes determining, by the controller, the concentration of the purge gas flowing into an intake system by using a diffusion/delay model of the purge gas until being discharged by the purge pump and flowing into the intake system of an engine through a purge passage.

The determining the target purge flow rate and the purge concentration of the purge gas by using the diffusion/delay model includes: dividing the purge passage into a predetermined number of cells, disposed along the longitudinal direction of the purge passage, where the predetermined number of cells includes an inlet cell into which the purge gas flows in from the purge valve, and an outlet cell through which the purge gas flows to an intake manifold; determining a number of cells in which the purge gas moves per a predetermined sampling cycle, allocating the purge concentration and the flow rate of the corresponding time point to a buffer corresponding to the cells of the determined number of cells from the inlet cell when the purge gas firstly flows therein, moving all the data inside the buffer toward the outlet cell by the determined number of cells per the sampling cycle, and determining the average value of the purge concentration stored in the buffer corresponding to the cells of the determined number of cells from the outlet cell as the purge concentration flowing into the intake system at the present time.

The determining the flow rate and the concentration of the purge gas flowing into the intake system by using the diffusion/delay model of the purge gas allocates the flow rate and the concentration of the corresponding purge gas to the buffer corresponding to the cells of the determined number of cells from the inlet cell, when a fresh purge gas is flowed therein after the purge gas has firstly been flowed therein.

Then, the concentration of the purge gas flowing into the intake system is determined by using a ratio of the total number of cells and the number of cells to which the purge gas concentration has been input to the buffer until now, when the fresh purge gas is not flowed therein after the purge gas has firstly been flowed therein.

In order to calculate the purge concentration more accurately, the calculating the purge concentration performs in the state where the purge valve for opening and closing the purge passage has been closed.

Meanwhile, the purge valve is controlled by using the previously (e.g., immediately before) calculated purge concentration, when a difference between the target RPM of the purge pump and the current RPM of the purge pump is out of the predetermined range even after the certain time has elapsed since the purge pump was driven.

A fuel amount control method according to the present disclosure for solving the above problem calculates the mass of the fuel components contained in the purge gas by using the purge gas concentration calculated by the above-described purge concentration calculation control method, and controls a fuel injection device of an engine by a value obtained by subtracting the mass of the fuel components contained in the purge gas among the target fuel injection amount according to the air amount flowing into the engine.

Then, the calculating the mass of the fuel components contained in the purge gas calculates the density of the fuel components in the purge gas by using the calculated purge gas concentration, compensates the calculated density of the fuel components according to the external air temperature and the altitude of a vehicle, and calculates the mass of the fuel components contained in the purge gas by the compensated density of the fuel components and the purge gas flow rate.

The purge gas flow rate at this time is calculated by using the RPM of the purge pump and the pressure difference at both ends of the purge pump.

In one form, the intake air amount into the engine is calculated by correcting the intake air amount into an intake manifold through a throttle valve by using the calculated purge gas flow rate.

According to the present disclosure, in the case of purging the evaporation gas by the active purge system, it is possible to accurately calculate the purge concentration to reflect it on a fuel amount control.

In addition, according to the present disclosure, in the case of purging the evaporation gas by the active purge system, it is possible to accurately estimate the purge concentration of the purge gas supplied to the intake manifold by reflecting the diffusion and the supply delay of the purge gas flowing along the purge passage. Therefore, it is possible to accurately control the fuel amount considering the flow rate of the purge and the concentration of the purge.

Therefore, according to the present disclosure, it is possible to effectively prevent the phenomena of the engine oscillation fault, the idle instability, the engine stall, and the like caused by the inflow of the purge gas.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 6A:
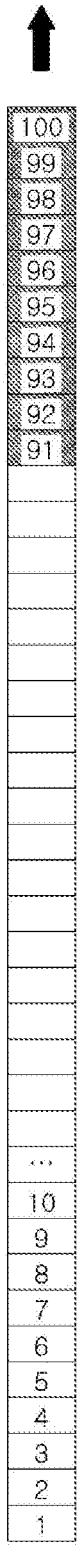
Figure 6B:
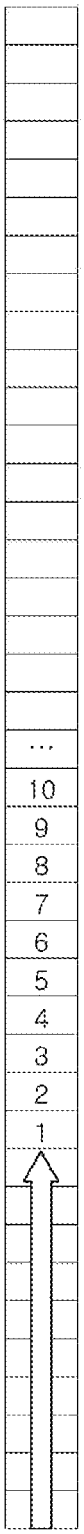
Figure 6C:
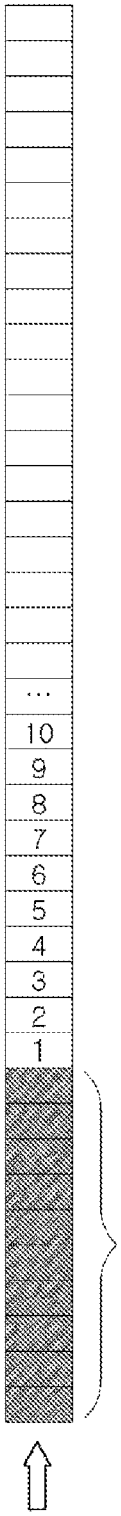
Figure 6D:
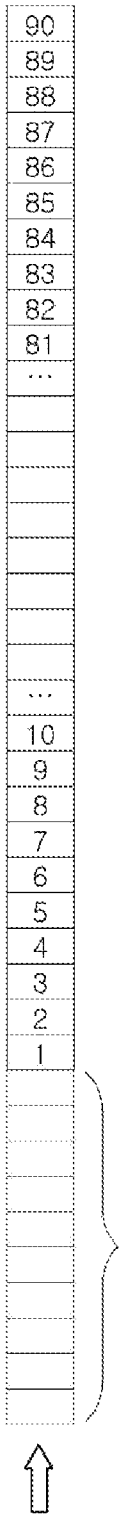
Figure 7:
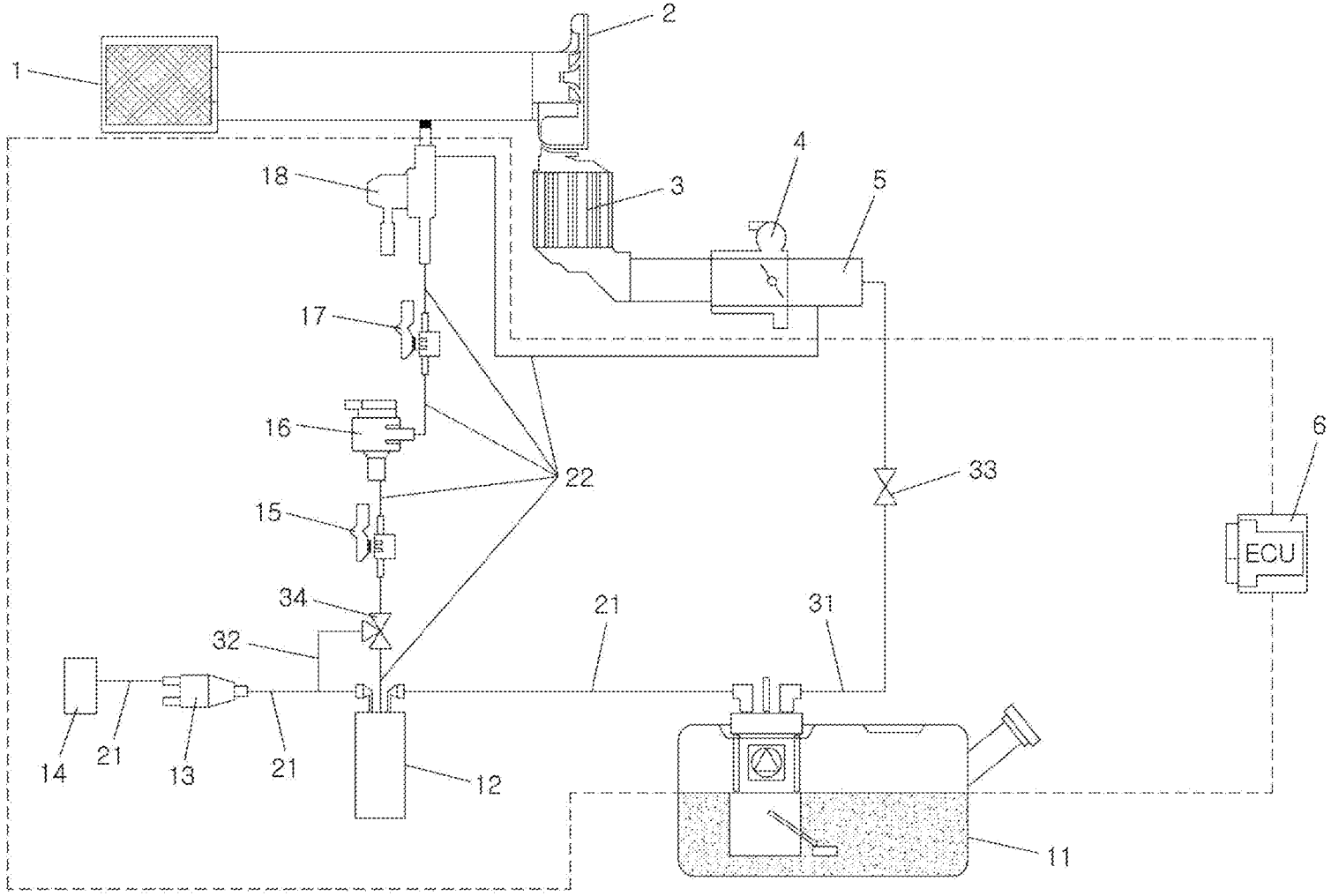

FIGS. 6A to 6D are diagrams for explaining a method for calculating the purge gas concentration flowed into an intake manifold by using the diffusion/delay model of the purge gas; and FIG. 7 is a configuration diagram of an active purge system to which the purge concentration calculation control method and the method for controlling the amount of fuel using the same according to one form of the present disclosure may be applied.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, a purge concentration calculation control method and a fuel amount control method using the same according to the present disclosure will be described in detail with reference to the accompanying drawings. However, a detailed description of known functions and configurations that may unnecessarily obscure the subject matter of the present disclosure will be omitted.

First, referring to FIG. 7, an active purge system to which a purge concentration calculation control method and a fuel amount control method using the same according to one form of the present disclosure may be applied will be described.

Referring to FIG. 7, the active purge system to which the purge concentration calculation control method and the fuel amount control method using the same may be applied may include: a fuel tank 11, a canister 12, a canister vent valve 13, a canister filter 14, a pressure and temperature sensor 15, a purge pump 16, a pressure sensor 17, a purge valve 18, and the like.

In the active purge system, the fuel evaporation gas formed by evaporating fuel stored in the fuel tank 11 is collected in the canister 12. The fuel evaporation gas collected in the canister 12 is extruded by the purge pump 16, and the fuel evaporation gas (purge gas) extruded by the purge pump 16 is supplied to an intake manifold 5 along a purge passage 22. The flow rate of the purge gas supplied at this time is adjusted by the RPM of the purge pump 16 and the opening of the purge valve 18. The pressure sensors 15, 17 for measuring the pressure of the purge gas at the front end and the rear end of the purge pump 16 are provided between the purge pump 16 and the canister 12, and between the purge pump 16 and the purge valve 18, respectively.

Figure 1A:
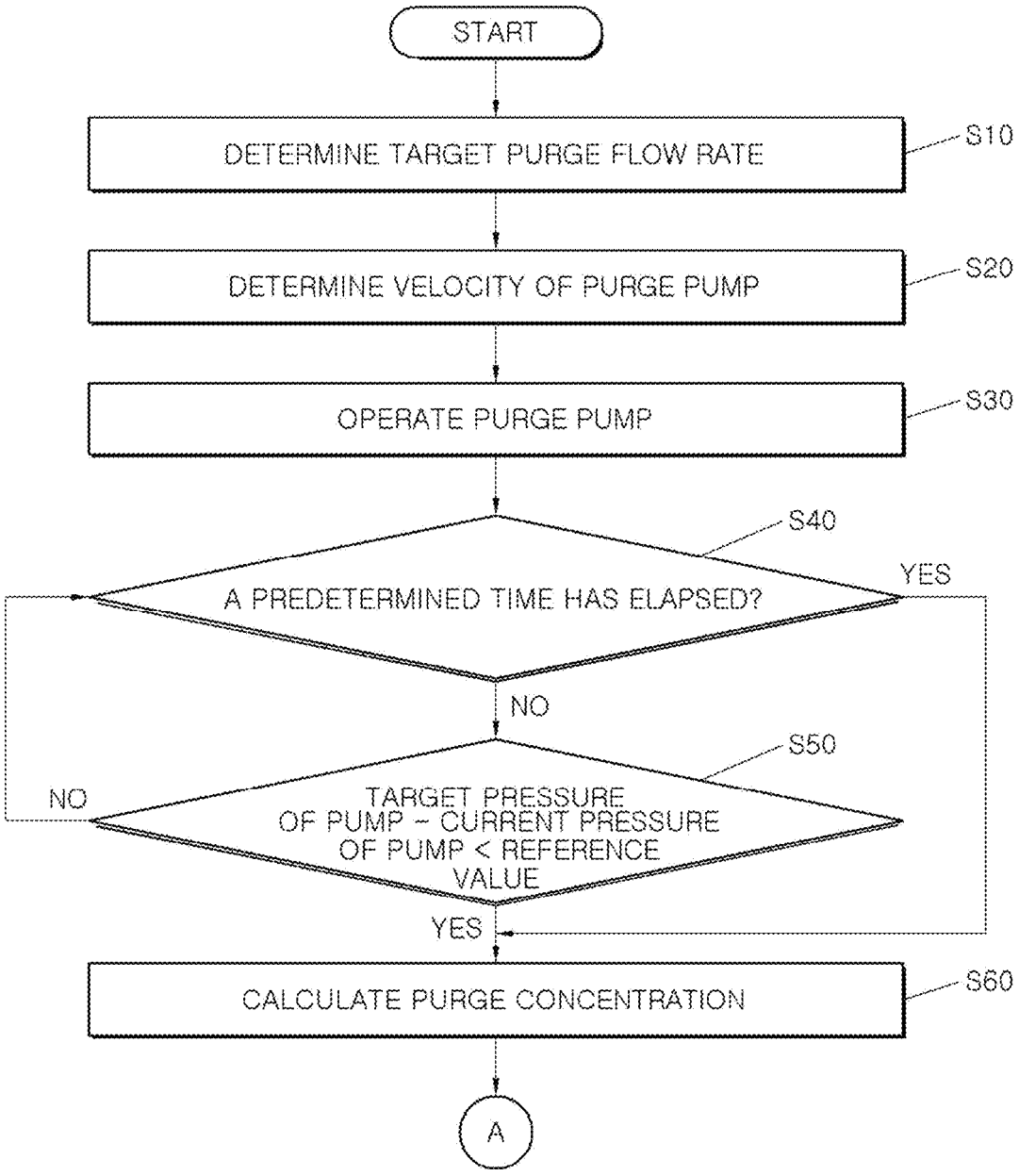
FIGS. 1A and 1B are flowcharts illustrating a purge concentration calculation control method and a fuel amount control method using the same according to one form of the present disclosure.
Figure 1B:
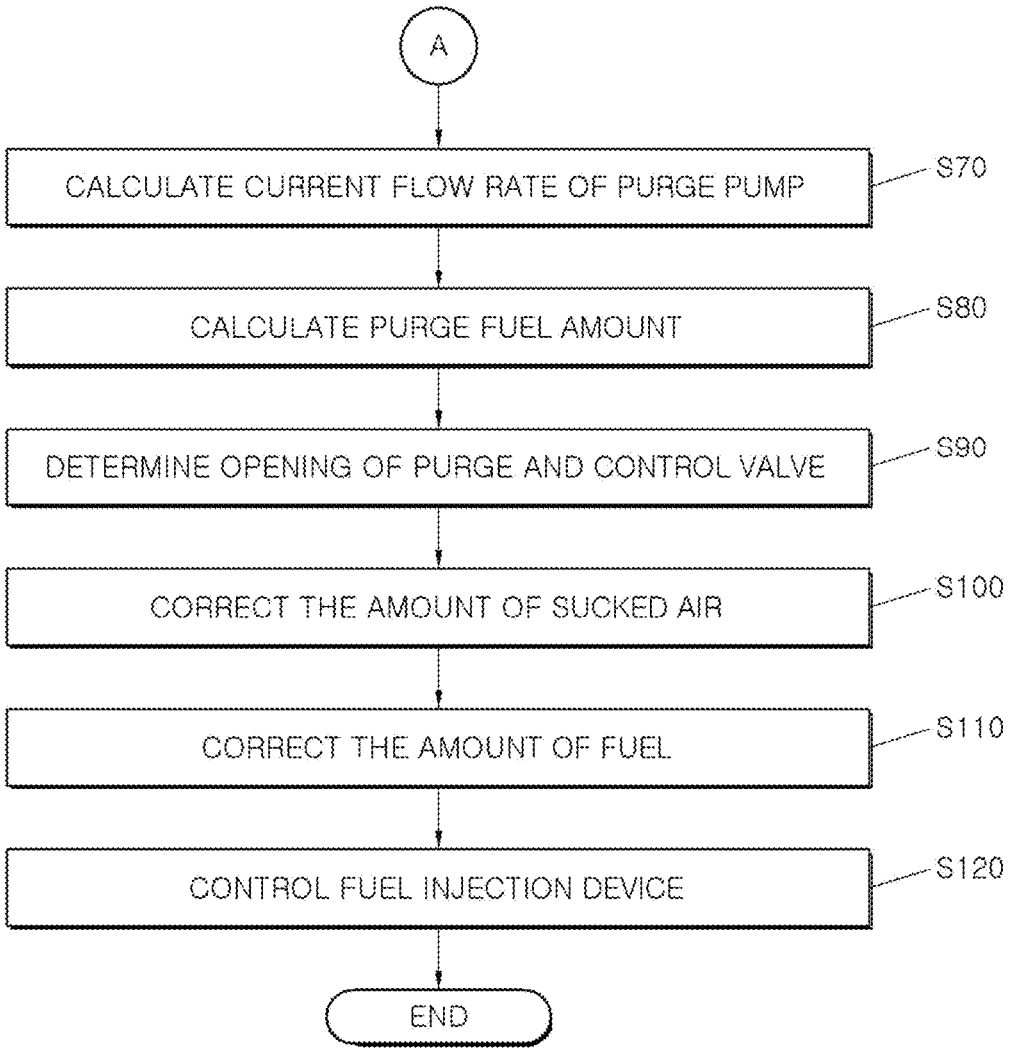

In FIG. 1, a reference numeral 6 refers to an Engine Control Unit (ECU), and the purge concentration calculation and the fuel amount using the same according to the present disclosure is controlled by the engine control unit 6.

Hereinafter, the purge concentration calculation control method and the fuel amount control method using the same according to the present disclosure will be described in detail with reference to FIGS. 1 to 4.

FIG. 1 is a flowchart illustrating a purge concentration calculation control method and a fuel amount control method using the same according to the present disclosure.

When the traveling state of a vehicle or the like satisfies the purge enabling state, the engine control unit 6 determines a target purge flow rate S10. In one form, the target purge flow rate may be determined by comprehensively considering the concentration and the flow rate of the purge gas calculated in the previous step, the operating state of the vehicle, the amount of the intake air and the amount of supplied air into the engine, and the like.

When the target purge flow rate is determined, the engine control unit 6 determines a target RPM of the purge pump 16 suitable for the target purge flow rate S20, and controls the purge pump 16 to be driven at the determined target RPM.

As will be described later, in the purge concentration calculation control method according to the present disclosure, the purge concentration is determined by using the relationship between the RPM of the purge pump 16 and the pressure value at the rear end of the purge pump 16. If the actual RPM of the purge pump 16 is not within a predetermined range from the target RPM, it is difficult to calculate the accurate purge concentration. In addition, in particular, as will be described later, there is a problem in that when the purge pump 16 is operated for a long time in the state where the purge valve 18 has been closed, the purge pump 16 is overheated. Therefore, in the control method according to the present disclosure, the purge concentration is calculated when a certain time has elapsed since an operation of the purge pump 16 started or when a difference between the target RPM of the purge pump 16 and the current RPM of the purge pump 16 is within a predetermined range.

For this purpose, the engine control unit 6 first determines whether a certain time has elapsed since the operation of the purge pump 16 started S40. When the predetermined certain time has elapsed, the engine control unit 6 performs calculating the purge concentration S60, which will be described later. Even if the predetermined certain time has not elapsed, the engine control unit 6 determines whether the difference between the target RPM of the purge pump 16 and the current RPM of the purge pump 16 has reached within a predetermined range S50, and when it is determined that the difference between the target RPM of the purge pump 16 and the current RPM of the purge pump 16 is within the predetermined range, it is determined that the environment capable of accurately calculating the purge concentration has been established, such that the engine control unit 6 may perform the calculating the purge concentration S60.

As in the case where a problem occurs in the measurement of the RPM of the purge pump 16, there may occur the case where the difference between the target RPM of the purge pump 16 and the current RPM of the purge pump 16 does not reach the predetermined range even if the predetermined certain time has elapsed. In this case, since it is difficult to accurately calculate the purge concentration, it is desired to control the active purge system and control the fuel amount by using the purge concentration calculated immediately before.

In the S60, the purge concentration is determined by using the relationship between the RPM of the purge pump 16 and the pressure value at the rear end of the purge pump 16. Determining the purge concentration in the S60 will be described in more detail with reference to FIGS. 2 and 3.

Figure 2:
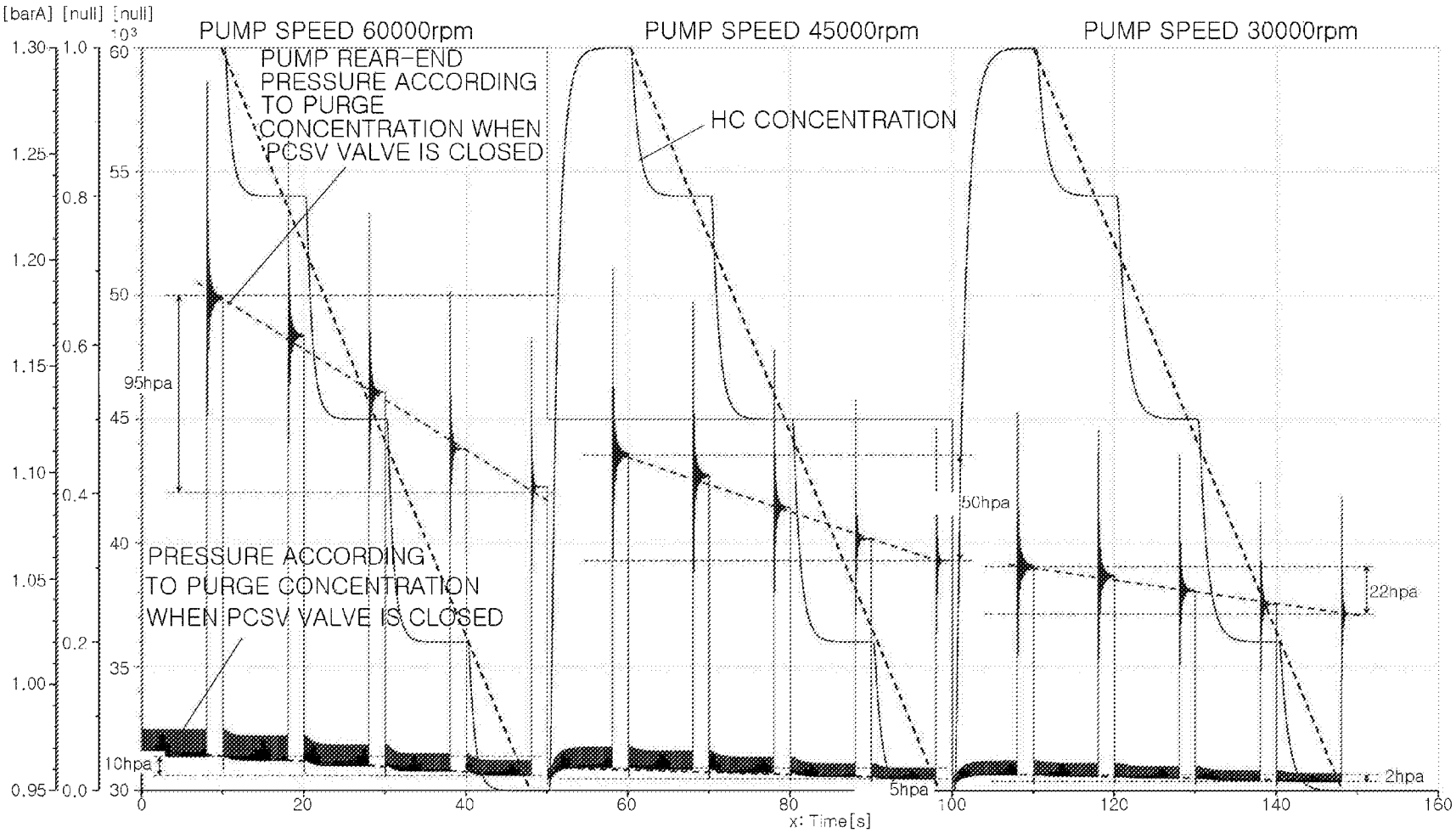
FIG. 2 is a graph illustrating the relationship between the rear end pressure of a purge pump and the RPM of the purge pump, and the purge concentration.

FIG. 2 is a graph illustrating the relationship between the rear end pressure of the purge pump and the RPM of the purge pump, and the purge concentration with time when the RPM of the purge pump 16 is 60000 rpm, 45000 rpm, and 30000 rpm, respectively.

As is well illustrated in the energy equation of the following Equation 1, a pressure difference $\Delta P_{APP}$ at both ends of the purge pump is proportional to the air density (ρ).

$$\Delta p_{APP} = K\frac{\rho}{2}(2\pi rf)^2 \quad \text{(Equation 1)}$$

Then, the purge gas containing the fuel component (hydrocarbon) becomes denser than pure air. Therefore, in particular, when the purge pump 16 is operated in the state where the purge valve 18 has been closed, the pressure at the rear end of the purge pump 16 in the purge gas containing hydrocarbon is higher than the pressure at the rear end of the purge pump 16 in the pure air.

This may also be seen from the contents of FIG. 2 illustrating a change in the pressure at the rear end of the purge pump 16 according to the concentration of the hydrocarbon (HC). Meanwhile, as illustrated in FIG. 2, it may be seen that when the purge valve 18 has been closed, a change in the pressure at the rear end of the purge pump 16 is much greater than a change in the pressure at the rear end of the purge pump 16 when the purge valve 18 has been opened. Therefore, in order to accurately measure the purge concentration, it is desired to drive the purge pump 16 in the state where the purge valve 18 has been closed.

Figure 3:
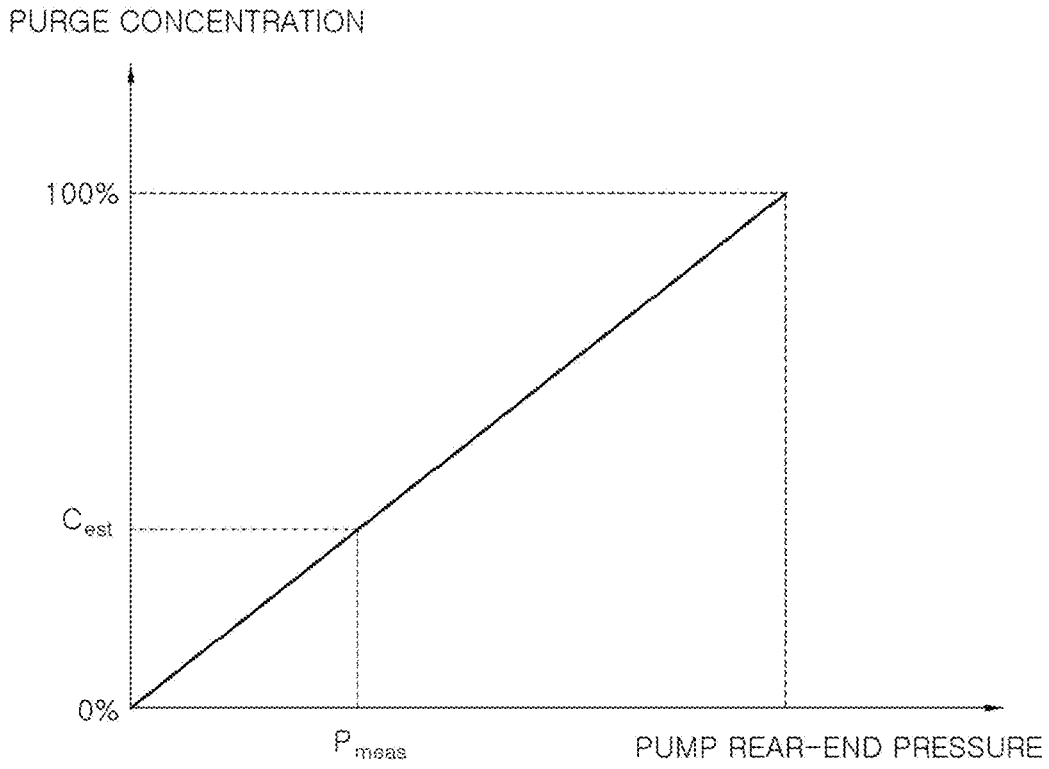
FIG. 3 is a graph illustrating the relationship between the purge concentration and the rear end pressure of the purge pump.

FIG. 3 is a graph illustrating the relationship between the purge concentration and the pressure at the rear end of the purge pump in the purge pump driven at a specific rpm. As illustrated in FIG. 3, the pressure at the rear end of the purge pump 16 and the purge concentration have a linear relationship at the specific RPM of the purge pump 16. Therefore, by using such a linear relationship, it is possible to estimate the purge concentration $C_{est}$ when the pressure $P_{meas}$ at the rear end of the purge pump 16 driven at a predetermined RPM is known. When the relationship between the pressure $P_{meas}$ at the rear end of the purge pump 16 and the purge concentration $C_{est}$, which are corresponding to each RPM of the purge pump 16, is made as a map, the engine control unit 6 may calculate the purge concentration by using the pressure value at the rear end of the purge pump 16 measured by the pressure sensor 17 and the map.

When the purge concentration is calculated, the engine control unit 6 calculates the flow rate of the current purge pump 16. For this purpose, the engine control unit 6 uses a difference value of the pressures at the front and rear ends of the purge pump 16 measured by the pressure sensors 15, 17, respectively.

Figure 4:
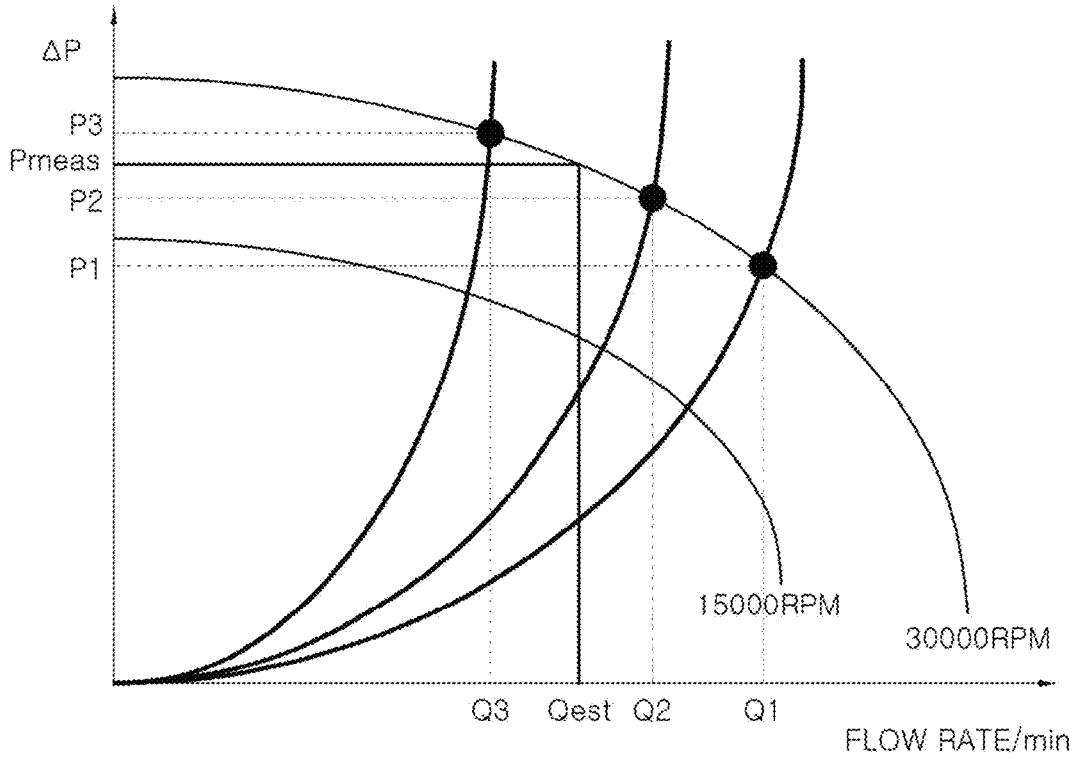
FIG. 4 is a graph illustrating the relationship between the flow rate of the purge gas and a pressure difference of the front and rear ends of the purge pump.

FIG. 4 illustrates the relationship between the pressure difference ΔP at the front and rear ends of the purge pump 16 and the purge flow rate Q when the drive RPM of the purge pump 16 is 15000 RPM and 30000 RPM, respectively. When the relationship between the pressure difference ΔP at the front and rear ends of the purge pump 16 and the purge flow rate Q, which are corresponding to each RPM of the purge pump 16, is made as a map, the engine control unit 6 may calculate the purge gas flow rate $Q_{est}$ by using the pressure values at the front and rear ends of the purge pump 16 measured by the pressure sensor 17 and the map.

By calculating the current purge gas flow rate, the mass of the fuel component currently contained in the purge gas may be calculated S80. Since the purge concentration previously calculated is a volume ratio, the density of the purge gas may be determined by the following Equation 2 when the purge concentration is known.

$$\rho_{bas} = \rho_{HC} \times \left(\frac{C}{100}\right) \quad \text{(Equation 2)}$$

Herein, $\rho_{bas}$: HC concentration in the purge gas, $\rho_{HC}$: a reference density of HC, c: purge concentration (HC concentration).

Meanwhile, since the HC density value in the purge gas varies according to the altitude of a vehicle and the external air temperature of the vehicle, it is desired to correct this portion.

In addition, in order to calculate the mass of the fuel component contained in the purge gas more accurately, a final HC density value $\rho_{act}$ is calculated by correcting the HC density $\rho_{bas}$ in the purge gas by using the following Equation 3 according to the altitude of the vehicle and the external air temperature of the vehicle.

$$\rho_{act} = \rho_{bas} * \frac{P}{1\ \text{atm}} * \frac{273.15}{(273.15 + temp)} \quad \text{(Equation 3)}$$

Herein, P: an atmospheric pressure according to the altitude of the vehicle, temp: external air temperature.

When the final HC density value $\rho_{act}$ is calculated, the mass M of the fuel component in the purge gas may be calculated as in the following Equation 4 by multiplying this value by the purge gas flow rate $Q_{set}$.

$$M = Qest \times \rho_{HC} \times \left(\frac{C}{100}\right) \times \frac{P}{1\ \text{atm}} \times \frac{273.15}{(273.15 + temp)} \quad \text{(Equation 4)}$$

When the purge gas flow rate Q and the mass M of the fuel component in the purge gas are calculated, the engine control unit 6 may control the purge valve 18 by setting the purge opening based on them. That is, it is possible to control the active purge system so that the fuel amount and the air amount set at the target purge flow rate may be satisfied by adjusting the opening of the purge valve 18 appropriately.

Meanwhile, as described above, when the purge gas flow rate Q and the mass M of the fuel component in the purge gas are calculated, it is possible to appropriately correct the fuel amount and the air amount based on them.

When the purge gas extruded from the purge pump 16 flows into the intake manifold 5 by driving the active purge system, the intake air amount into the engine is changed. That is, the sum of the intake air amount through a throttle valve 4 and the purge gas flow rate becomes the intake air amount into each cylinder of the engine. Therefore, the engine control unit 6 performs the correction for using the sum of the air amount measured by a MAF sensor and the purge gas flow rate Q as the intake air amount in order to correct the air amount used in an air-fuel ratio control S100.

Meanwhile, when the purge gas extruded from the purge pump 16 flows into the intake manifold 5 by driving the active purge system, the fuel amount contained in the mixture is also changed. That is, the sum of the fuel amount injected into the intake air through a fuel injection device and the mass M of the fuel component in the purge gas becomes the actual fuel amount in the mixer. Therefore, the engine control unit 6 performs the correction for using the sum of the fuel amount injected by an injector and the mass M of the fuel component in the purge gas as the fuel amount in the mixture in order to correct the air amount used in an air-fuel ratio control S110.

The engine control unit 6 controls the throttle valve 4 and the fuel injection device in order to achieve the target air-fuel ratio according to the driving state of the engine based on the values of the corrected amounts of the intake air and the fuel. As a result, even when rich purge gas or lean purge gas has flowed through the purge passage, it may be reflected in the air-fuel ratio control, thereby preventing the engine from suddenly stopping.

Meanwhile, as described above, since the purge passage 22 from which the purge gas is supplied from the purge pump 16 to the intake manifold 5 is long, the time is delayed until the purge gas discharged from the purge pump 16 reaches the intake manifold 5. Therefore, even if the purge concentration is accurately calculated by the purge concentration calculation control method illustrated in FIG. 1, it is not easy to estimate the flow-in time point flowed into the intake manifold 5 through the purge passage 22 and the concentration thereof at that time. Therefore, in the present disclosure, by using the diffusion/delay model of the purge gas discharged by the purge pump 16 and flowed into the intake manifold 5 of the engine through the purge flow path 22, the flow rate and the concentration of the purge gas flowed into the intake system are determined. Hereinafter, a method for determining the flow rate and the concentration of the purge gas using the diffusion/delay model of the purge gas will be described in detail with reference to FIGS. 5A to 5C and FIGS. 6A to 6D.

Figure 5A:
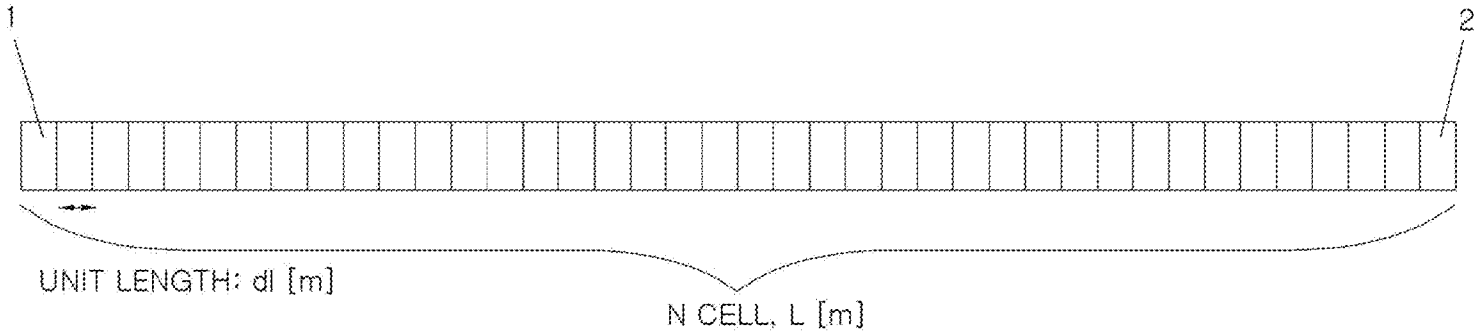
FIGS. 5A to 5C are diagrams for explaining a diffusion/delay model of the purge gas used in the purge concentration calculation control method according to one form of the present disclosure.
Figure 5B:
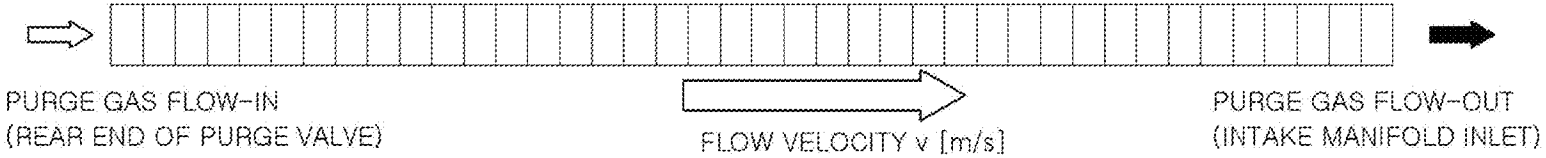
Figure 5C:
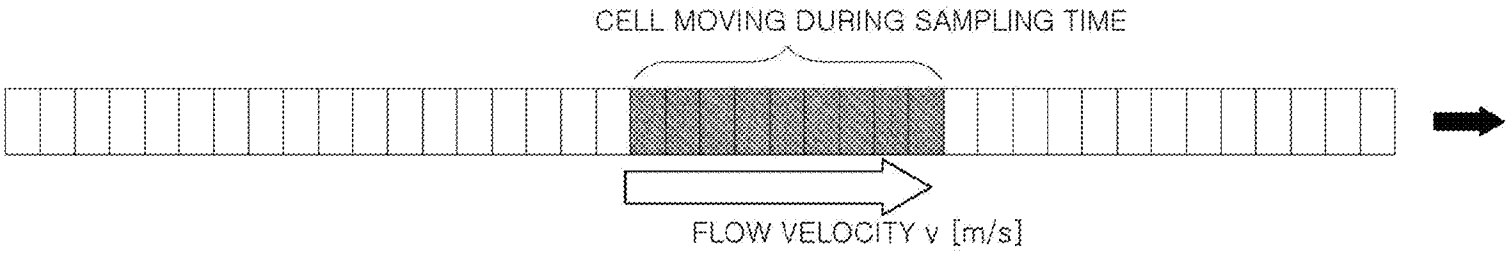

FIGS. 5A to 5C are diagrams for explaining the diffusion/delay model of the purge gas used in the purge concentration calculation control method according to the present disclosure.

As illustrated in FIG. 5A, the diffusion/delay model of the purge gas has a buffer composed of a predetermined number N of cells. Each cell is provided by extending in the longitudinal direction thereof, and the entire cell represents the purge passage 22. Therefore, the total length of the buffer represents the length L of the purge passage, and the unit length dl of one cell constituting the N cells of the buffer is a value (L/M) obtained by dividing the total length L by the number N of cells.

As illustrated in FIG. 5B, the first cell 1 is extruded by the purge pump 16 and becomes an inlet through which the purge gas whose flow rate is controlled by the purge valve 18 flows into the purge passage. Then, the last cell 2 becomes the outlet of the purge passage 22 out which the purge gas flows to the intake manifold 5. That is, the purge gas flows into the first cell 1, and flows out from the last cell 2, and at this time, it is assumed that the flow velocity v inside the purge passage 22 is constant, and the received purge gas moves toward the outlet at the velocity corresponding to the corresponding flow velocity v. That is, it is assumed that there is no compression of the purge gas in the purge passage 22. The flow velocity v at this time is a value ($L/t_{delay}$) obtained by dividing the length of the purge passage 22 by the delay time $t_{delay}$ when the purge gas reaches from the inlet to the outlet.

As illustrated in FIG. 5C, since the purge gas moves continuously in the purge passage 22, one cell is moved by the predetermined number of cells for a predetermined time.

That is, when the sampling time in the model is dT, the distance $d_{flow}$ moved during the sampling time is a value obtained by multiplying the flow velocity v by the sampling time dT, that is, $L/t_{delay} \times dT$, and therefore, the number of cells moved during the sampling time is a value obtained by dividing $L/t_{delay} \times dT$ by the length per cell, and therefore, becomes $dT \times N/t_{delay}$. At this time, since the number of cells is an integer, a value after the decimal point is discarded becomes the number of cells moving during the sampling time.

As described above, the diffusion/delay model of the purge gas according to the present disclosure divides the purge passage into the predetermined number of cells, and implements the diffusion/delay model by moving the cells per unit time (sampling time).

FIGS. 6A to 6D are diagrams for explaining a method for calculating the purge gas concentration flowed into the intake manifold by using the diffusion/delay model of the purge gas.

One form of the diffusion/delay model of purge gas in FIG. 6A has a buffer composed of 100 cells. Then, the delay time is obtained by using the information related to the flow velocity of the purge gas such as the purge gas flow rate Q, and the number of cells moving during the sampling time dT is calculated by using a predetermined sampling time dT and a predetermined number of cells. In this example, the number of cells moving during the sampling time dT is ten. Therefore, the last ten cells deeply colored in FIG. 6A represent the purge gas moving to the intake manifold 10 during the sampling time dT.

When the first purge gas flows into the purge passage 22, the purge concentration and the flow rate at the corresponding time point are allocated to the buffer corresponding to the cell 10 of the number of cells (ten in this example) previously determined before the first cell 1. At this time, the same value is allocated to all ten cells.

Then, as illustrated in FIG. 6B, all data in the buffer are moved by the determined number of cells toward the outlet per a sampling cycle. At this time, the average value of the purge gas concentrations stored in the last ten cells deeply colored in FIG. 6A becomes the concentration of the purge gas flowing into the intake manifold 5.

Meanwhile, as illustrated in FIG. 6C, when a fresh purge gas is continuously flowed therein, the flow rate and the concentration of the purge gas flowing into the buffer corresponding to the cells of the number of cells determined from the first cell are newly allocated. Subsequently, when the purge gas flows into the purge passage 22, the procedures of FIGS. 6B and 6C are repeatedly performed. Meanwhile, when the purge gas flow rate is changed in the procedure, the number of cells moving during the sampling time dT is recalculated to move the cell (update the value stored in the buffer of each cell).

Meanwhile, when the flow-in of the fresh purge gas is stopped as illustrated in FIG. 6D, the cells during the sampling cycle in which the flow-in of the purge gas has been stopped become empty buffers to which the purge concentration is not allocated. Then, at this time, the concentration of the purge gas flowing into the intake manifold 5 is calculated by multiplying a ratio of the number of cells into which the purge gas concentration has been input to the buffer until now by the average value of the purge gas concentration allocated to the cell. In the example of FIG. 6D, since the purge gas concentration is allocated to 90 cells, the purge concentration at this time becomes 90% of the average value of the purge concentration stored in the cell.

By using the above-described diffusion/delay model of the purge gas, it is possible to calculate the concentration of the purge gas at the time point when the purge gas reaches the intake manifold 5 in a simple method.

The forms disclosed the specification and the accompanying drawings are only used for easily explaining the technical spirit of the present disclosure, and are not used for limiting the scope of the present disclosure recited in the claims, and therefore, it is to be understood by those skilled in the art that various modifications and equivalent other forms therefrom may be made.

What is claimed is:

1. A purge concentration calculation control method in an active purge system for purging a fuel evaporation gas (purge gas) by using a purge pump, the method comprising:

calculating, by a controller, a purge concentration of the purge gas based on revolutions per minute (RPM) of the purge pump, and a pressure at a rear end of the purge pump;

determining, by the controller, a target purge flow rate of the purge gas based on the calculated purge concentration and a flow rate of the purge gas;

controlling, by the controller, a purge valve based on the target purge flow rate and a purge fuel amount; and determining, by the controller, the purge concentration of the purge gas flowing into an intake system by using a diffusion/delay model of the purge gas until being discharged by the purge pump and flowing into the intake system of an engine through a purge passage.

2. The purge concentration calculation control method of claim 1, wherein the purge concentration is calculated when a certain time has elapsed since an operation of the purge pump started or when a difference between a target RPM of the purge pump and a current RPM of the purge pump is within a predetermined range.

3. The purge concentration calculation control method of claim 1, wherein determining the target purge flow rate and the purge concentration of the purge gas by using the diffusion/delay model comprises:

dividing the purge passage into a predetermined number of cells, disposed along a longitudinal direction of the purge passage, the predetermined number of cells including an inlet cell into which the purge gas flows in from the purge valve and an outlet cell through which the purge gas flows to an intake manifold;

determining a number of cells in which the purge gas moves per a predetermined sampling cycle;

allocating the purge concentration and a flow rate of a corresponding time point to a buffer corresponding to cells of the determined number of cells from the inlet cell when the purge gas is firstly flowed therein;

moving all data inside the buffer toward the outlet cell by the determined number of cells per the sampling cycle; and determining an average value of the purge concentration stored in the buffer corresponding to the cells of the determined number of cells from the outlet cell as the purge concentration flowing into the intake system at a present time.

4. The purge concentration calculation control method of claim 3, further comprising: allocating the flow rate and the purge concentration of the corresponding purge gas to the buffer corresponding to the cells of the determined number of cells from the inlet cell, when a fresh purge gas is flowed therein after the purge gas has firstly been flowed therein.

5. The purge concentration calculation control method of claim 4, comprising: determining the purge concentration of the purge gas flowing into the intake system by using a ratio of a total number of cells and a number of cells to which the purge gas concentration has been input to the buffer, when the fresh purge gas is not flowed therein after the purge gas has firstly been flowed therein.

6. The purge concentration calculation control method of claim 1, wherein calculating the purge concentration performs in a state where the purge valve for opening and closing the purge passage has been closed.

7. The purge concentration calculation control method of claim 2, comprising: controlling the purge valve by using previously calculated purge concentration when the difference between the target RPM of the purge pump and the current RPM of the purge pump is out of the predetermined range even after the certain time has elapsed.

8. A fuel amount control method, comprising:

calculating, by a controller, a purge concentration of the purge gas based on revolutions per minute (RPM) of the purge pump, and a pressure at a rear end of the purge pump;

determining, by the controller, a target purge flow rate of the purge gas based on the calculated purge gas concentration and a flow rate of the purge gas;

controlling, by the controller, a purge valve based on the target purge flow rate and a purge fuel amount;

determining, by the controller, the purge concentration of the purge gas flowing into an intake system by using a diffusion/delay model of the purge gas until being discharged by the purge pump and flowing into the intake system of an engine through a purge passage;

calculating a mass of a fuel component contained in the purge gas based on the calculated purge gas concentration; and controlling a fuel injection device of an engine by a value obtained by subtracting the mass of the fuel component contained in the purge gas among a target fuel injection amount according to an air amount flowing into the engine.

9. The fuel amount control method of claim 8, wherein calculating the mass of the fuel component contained in the purge gas comprises:

calculating a density of the fuel component in the purge gas by using the calculated purge gas concentration;

compensating the calculated density of the fuel component according to an external air temperature and an altitude of a vehicle; and calculating the mass of the fuel component contained in the purge gas by the compensated density of the fuel component and the purge gas flow rate.

10. The fuel amount control method of claim 9, wherein the purge gas flow rate is calculated by using the RPM of the purge pump and a pressure difference measured at a first end and a second end of the purge pump.

11. The fuel amount control method of claim 10, further comprising: calculating an intake air amount flowing into the engine by correcting an intake air amount flowing into an intake manifold through a throttle valve by using the calculated purge gas flow rate.

* * * * *